US007396104B2

(12) United States Patent
Ishiyama et al.

(10) Patent No.: US 7,396,104 B2
(45) Date of Patent: Jul. 8, 2008

(54) INK-JET RECORDING DEVICE AND WIPING METHOD

(75) Inventors: Toshinori Ishiyama, Kanagawa (JP); Hiroshi Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 11/189,299

(22) Filed: Jul. 26, 2005

(65) Prior Publication Data

US 2006/0176334 A1 Aug. 10, 2006

(30) Foreign Application Priority Data

Feb. 10, 2005 (JP) ..... 2005-034491

(51) Int. Cl.
*B41J 2/165* (2006.01)
*B41J 29/38* (2006.01)

(52) U.S. Cl. ..... 347/33; 347/10

(58) Field of Classification Search ..... 347/33, 347/10, 11, 68
See application file for complete search history.

(56) References Cited

U.S. PATENT DOCUMENTS 6,158,839 A * 12/2000 Fukushima et al. ..... 347/33
6,598,950 B1 * 7/2003 Hosono et al. ..... 347/11
6,945,627 B2 * 9/2005 Yamaguchi ..... 347/27

FOREIGN PATENT DOCUMENTS

JP 03-099857 * 4/1991
JP 3-293140 12/1991
JP 404080037 A * 3/1992

* cited by examiner

*Primary Examiner*—Shih-wen Hsieh
(74) *Attorney, Agent, or Firm*—Fildes & Outland, P.C.

(57) ABSTRACT

The ink-jet recording device of the present invention is provided with an ink-jet recording head that operates pressure waves on ink in a pressure chamber and ejects ink droplets from multiple nozzles; a wiper that wipes a nozzle face of the ink-jet recording head; a drive waveform applying component that applies a drive waveform to a drive element so that ink droplets are not ejected and ink floods the nozzle face; and a control component that, when performing wiping, drives the drive waveform applying component prior to initiating wiping and actuates the wiper in a state where the ink is flooded on the nozzle face.

14 Claims, 5 Drawing Sheets

INK-JET RECORDING DEVICE AND WIPING METHOD

CROSS-REFERENCE TO RELATED APPLICATION

This application claims priority under 35 U.S.C. 119 from Japanese Patent Application No. 2005-034491, the disclosure of which is incorporated by reference herein.

BACKGROUND OF THE INVENTION

1. Field of the Invention

The present invention relates to an ink-jet recording device that ejects ink droplets from multiple nozzles onto a recording medium and records an image, and to a wiping method for the nozzle face of the ink-jet recording device.

2. Description of the Related Art

Conventional ink-jet recording devices that eject ink droplets from multiple nozzles and perform printing on a recording medium such as paper have various benefits, such as being compact, affordable, and quiet. Such printers are widely sold on the market. Recording devices of piezo ink-jet systems that use piezoelectric elements and eject ink droplets by changing the pressure of a pressure chamber have especially many assets, where high-speed printing and high resolution can be obtained.

In this type of ink-jet recording device, when the wiping of an ink-jet recording head (hereafter, "recording head") is performed with a wiper, there is a danger of harming the nozzle surface if the wiping is performed when the wiper or recording head surface is in a dried state (i.e., dry wiping). Further, with dry wiping there is a problem in that fixed particles stuck to the recording head surface cannot be removed. On the other hand, when wiping directly after ink suction is performed for recovery from bubble engulfment and ink thickener, a large amount of ink remains on the nozzle surface. Accordingly, even if wiping is performed where the wiper is in a dried state, this becomes wet wiping, which does not pose aforementioned problems.

In a situation, for example, where faulty discharging occurs at a portion of the nozzles, the periphery of those nozzles becomes dirty. As a result, in a situation where faulty direction discharging occurs, suction of the ink is not necessary and the discharging condition can be recovered with the performance of wiping only. At this time, since dirtying by ink does not occur at nozzle peripheries separated by a certain distance from the faulty nozzles, if wiping is performed as is, the wiping at those nozzles becomes dry wiping, which is disadvantageous. In order to avoid this, the following approaches can be considered: (1) Performing wiping of the faulty nozzle(s) only; (2) Wetting the wiper itself; (3) Performing suction and wetting all of the nozzle faces; (4) Wetting the wiper by performing wiping while discharging (ink).

Nonetheless, it should be noted that approach (1) is not realistic in that mechanisms for establishing a method of specifying the faulty nozzle(s) and wiping only the specified nozzles become necessary. Approach (2) is not preferable since a mechanism for wetting the wiper becomes additionally necessary. Approach (3), despite a new mechanism not being especially necessary, is not preferable in that the amount of ink consumption increases, and approach (4) has a flaw in that the inside of the device is dirtied by ejected ink droplets.

Meanwhile, there have been proposals for means for removing ink stuck at the nozzle peripheries. For example, the application of waveform voltage that expands to the nozzle peripheries without discharging ink, and coalesces ink mist stuck to the nozzle peripheries and flooded ink, has been proposed. Here, back pressure and surface tension are used and the ink is suctioned into the interior of the nozzles (see, for example, the Official Gazette of Japanese Patent Application Laid-Open (JP-A) No. 3-293140).

Nonetheless, with the technique recited in the Official Gazette of JP-A No. 3-293140, only the nozzle peripheries are cleaned since wiping of the recording head with a wiper is not performed. Further, this has a flaw in that dirt besides ink such as paper particles are also suctioned into the interiors of the nozzles.

SUMMARY OF THE INVENTION

The present invention has been made in view of the above circumstances and provides an ink-jet recording device and wiping method.

An ink-jet recording device of a first aspect of the present invention has: an ink-jet recording head that operates pressure waves on ink in a pressure chamber and ejects ink droplets from plural nozzles; a wiper that wipes a nozzle face of the ink-jet recording head; a drive waveform applying component that applies a drive waveform to a drive element such that ink droplets are not ejected and ink floods the nozzle face; and a control component that, when wiping is being performed, drives the drive waveform applying component prior to the initiation of wiping and actuates the wiper when the ink is in a flooded condition on the nozzle face.

In the first aspect of the present invention, when performing wiping of the nozzle surface, a drive waveform is applied to the drive element by the drive waveform applying component so that, prior to the initiation of wiping, ink droplets are not ejected and ink floods the nozzle face. Then the control component actuates the wiper and wipes the nozzle face in a state where ink is flooded on the nozzle face. Due to this, the contacting surfaces of the wiper and the ink-jet recording head are in a wet state from immediately after the initiation of wiping. When compared to cases where wiping is performed in a dried state, damage to the nozzle face due to friction is alleviated. Further, by performing wiping in a wet state, it becomes possible to remove fixed particles stuck to the nozzle face.

A second aspect of the present invention is a wiping method that wipes a nozzle face of an ink-jet recording head without performing suction of ink. The present method involves applying a drive waveform to a drive element so that, prior to initiating wiping, ink droplets are not ejected and ink floods the nozzle face; and wiping the nozzle face in a state where ink is flooded on the nozzle face.

With the second aspect of the present invention, when wiping the nozzle surface without performing ink suction, prior to initiating wiping, a drive waveform is applied to the drive element such that ink droplets are not ejected and ink floods the nozzle face. Next, the nozzle face is wiped in a state where ink is flooded on the nozzle face. Due to this, the contacting surfaces of the wiper and the ink-jet recording head are in a wet state from immediately after the initiation of wiping. When compared to cases where wiping is performed in a dried state, damage to the nozzle face due to friction is alleviated. Further, by performing wiping in a wet state, it becomes possible to remove fixed particles stuck to the nozzle face.

Due to the present invention, the contacting surfaces of the wiper and the ink-jet recording head are in a wet state from immediately after the initiation of wiping. For this reason, damage to the nozzle face due to friction can be prevented while fixed particles stuck to the nozzle face can be removed.

BRIEF DESCRIPTION OF THE DRAWINGS

The preferred embodiment of the present invention will be described in detail based on the following figures, wherein.

DETAILED DESCRIPTION OF THE INVENTION

Hereafter, the best embodiment of the ink-jet recording device of the present invention will be explained based on the drawings.

Figure 1:
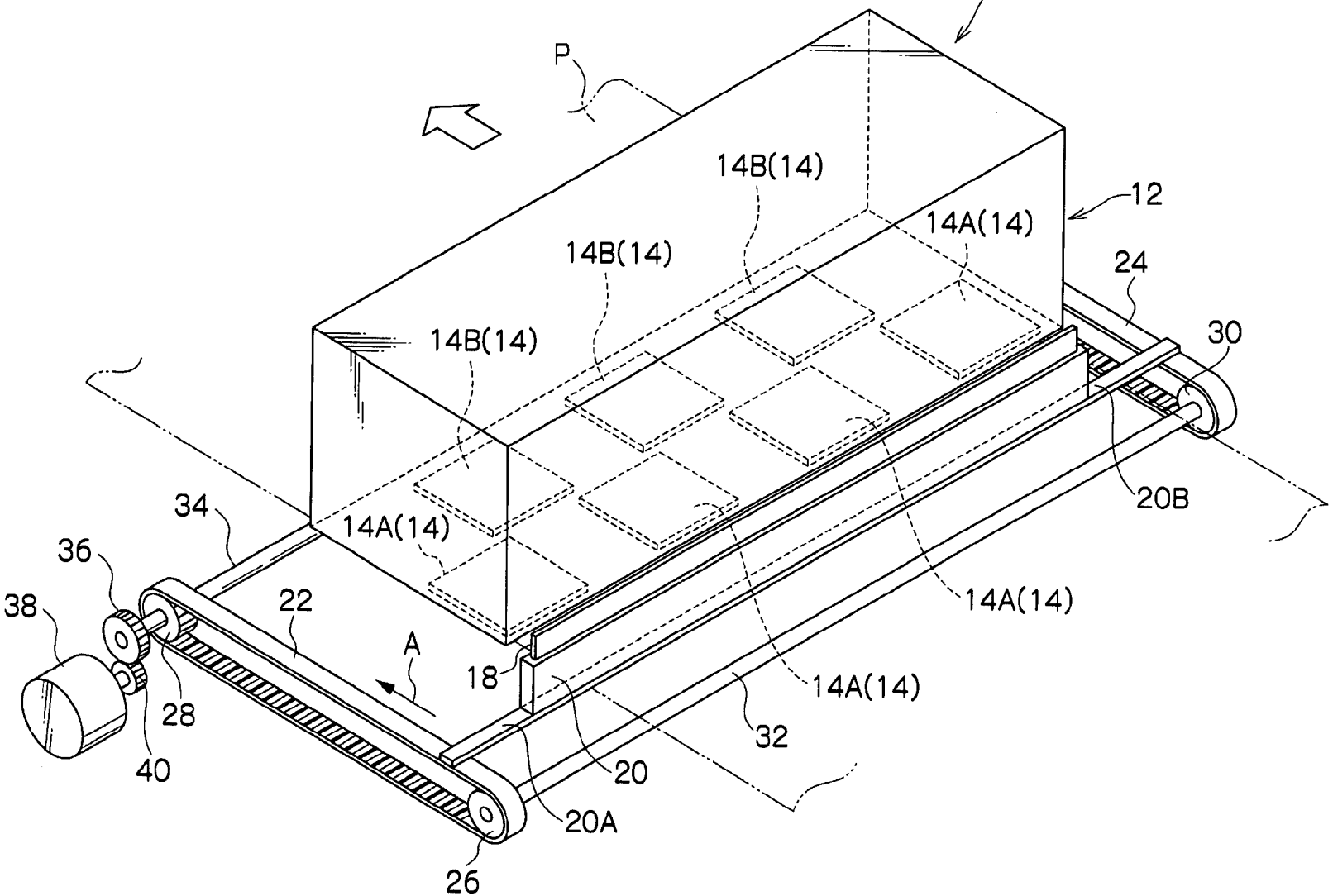
FIG. 1 is a partial perspective drawing showing an ink-jet recording device of one embodiment of the present invention.

The overall structure of an ink-jet recording device 10 of one embodiment of the present invention is shown in FIG. 1.

As shown in FIG. 1, the ink-jet recording device 10 is made such that a paper P can be conveyed as a recording medium. An ink-jet recording head (hereafter, "recording head") 12 of a width wider than the widest width of this paper P is provided at the upper part of the conveying route of the paper P. This recording head 12 comprises multiple unit heads 14 that are arranged in hound's-tooth formation at the upstream side and downstream side of the conveyed paper P.

Figure 2:
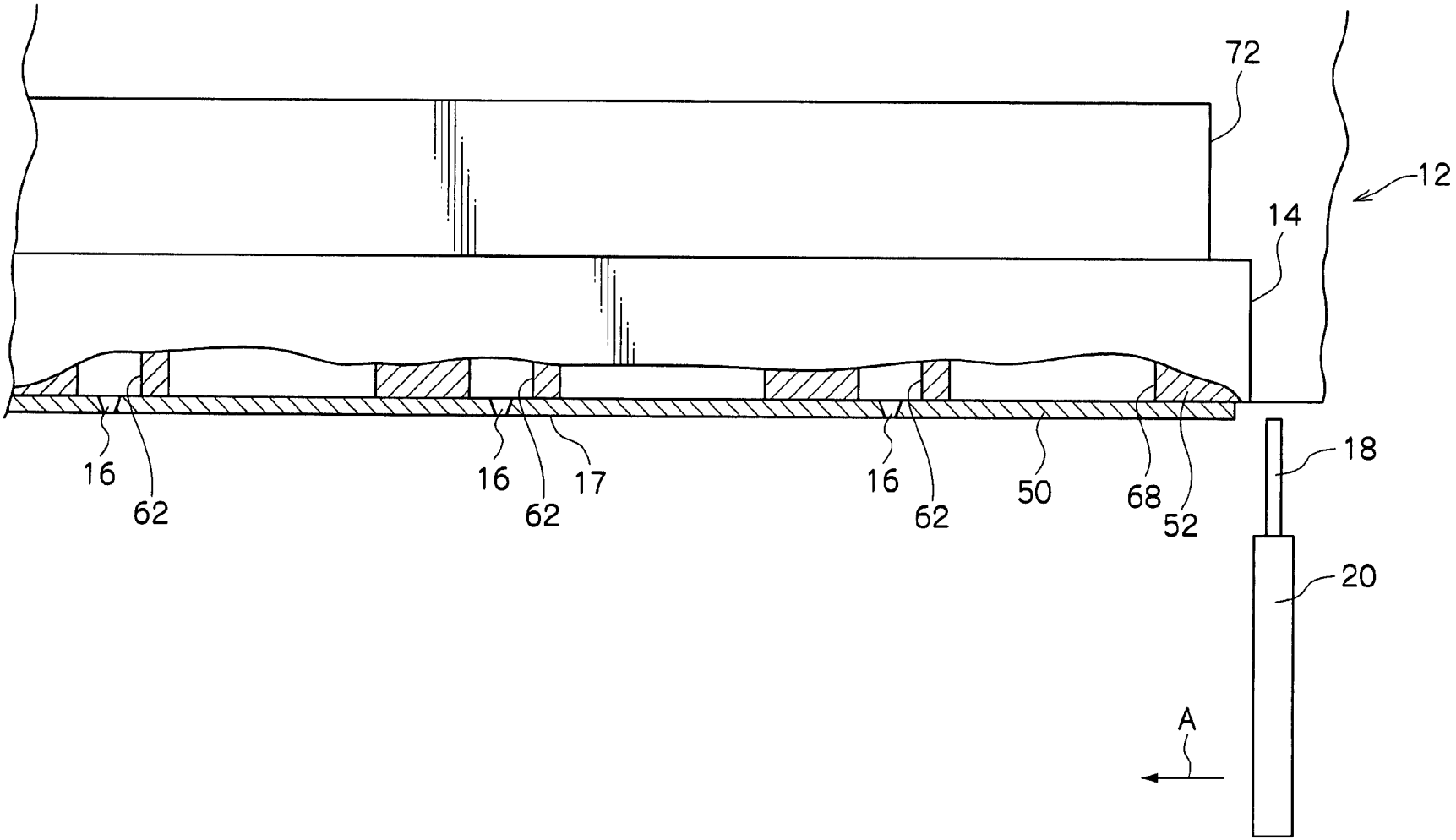
FIG. 2 is a partial block diagram showing a wiper plate and recording head of the ink-jet recording device shown in FIG. 1.
Figure 3:
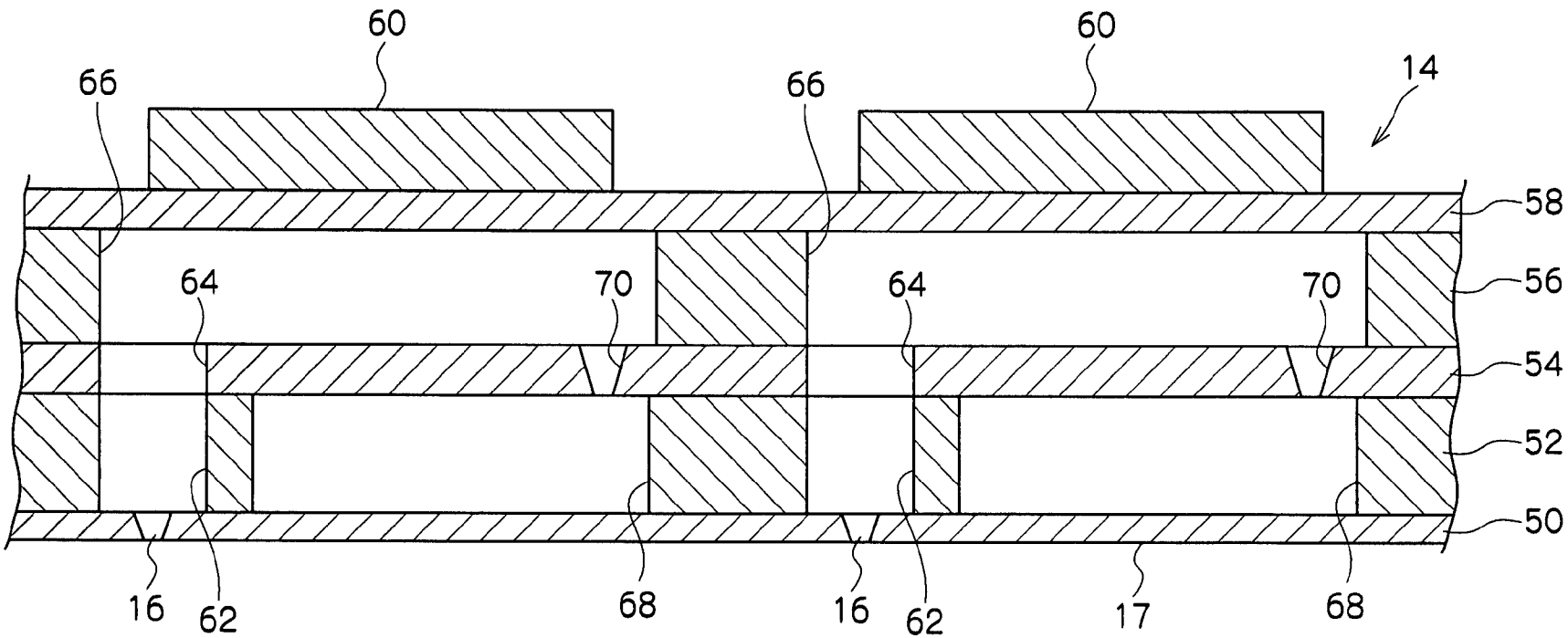
FIG. 3 is a partial cross-sectional drawing showing the recording head of the ink-jet recording device shown in FIG. 1.

As shown in FIGS. 2 and 3, multiple nozzles 16 are formed at the undersurface of the unit head 14 (i.e., the surface facing the paper P) and ink droplets are ejected from these nozzles 16 in accordance with image data. Accordingly, on the paper P on which image recording has been completed, the regions recorded with unit heads 14A positioned upstream of the recording head 12 and the regions recorded with unit heads 14B positioned downstream of the recording head 12 become alternately lined along the widthwise direction of the paper P.

Here, with two unit heads 14A, 14B adjoining in the widthwise direction of the conveyed paper P and arranged so that the end portions of the unit heads 14A, 14B overlap each other, no regions are generated within the printing region that cannot be printed.

In this manner, the unit heads 14A, 14B are lined in the widthwise direction of the paper P and form the printing region, whereby it is not necessary to move the recording head 12 in the widthwise direction of the paper P. A high rate of productivity can be obtained since the image is formed on the entire surface of the paper P with the movement of the paper P.

As shown in FIGS. 1 and 2, a rubber wiper plate 18 that wipes a nozzle face 17 of the unit head 14 is provided at the downward portion of the recording head 12. The edge surface of this wiper plate 18 is horizontal and is accommodated within a box-shaped wiper holder 20 such that the edge side is in a state where it is exposed.

Support pieces 20A, 20B each jut out along the widthwise direction of the recording head 12 from both ends at the undersurface of the wiper holder 20, and the end portions are fixed to belts 22, 24. The belt 22 is arranged parallel to the conveying direction of the paper P in a state where it is wound around pulleys 26, 28, and the belt 24 is arranged parallel to the conveying direction of the paper P in a state where it is wound around a pulley 30 and a pulley that has not been shown in the drawings. The pulley 26 and the pulley 30 are connected with a shaft 32, and the pulley 28 and the pulley not shown in the drawings are connected with a shaft 34.

A gear 36 is connected to the pulley 28. This gear 36 is made so as to engage a gear 40 connected to a motor 38, and when the motor 38 drives, the driving force is transmitted to the pulley 28 through the gears 40, 36. When the pulley 28 rotates with this driving force, the pulley not shown in the drawings rotates therewith via the shaft 34, and the pulleys 26, 30 rotate via the belts 22, 24. At this time, since the belts 22, 24 move parallel to the movement direction of the paper P, it becomes possible for the wiper plate 18 to move along the direction of the A arrow through the support pieces 20A, 20B and the wiper holder 20.

It should be noted that although the wiper plate 18 is formed across the entire width of the widthwise direction of the recording head 12, this can be configured such that multiple wiper plates are set in the widthwise direction and divided for each of the multiple unit heads 14. The multiple wiper plates can be respectively driven so as to wipe each of the unit heads 14.

As shown in FIG. 3, the unit head 14 has a flow path forming plate 52, a continuous hole plate 54, a pressure chamber plate 56, and an oscillation board 58 positioned and stacked on the nozzle plate 50 in which multiple nozzles 16 are formed, and these are joined with a joining means such as an adhesive.

Multiple continuous holes 62 leading to the nozzles 16 are formed in the flow path forming plate 52, and multiple continuous holes 64 are formed in the continuous hole plate 54. These nozzles 16, continuous holes 62, and continuous holes 64 are communicated with each other and are linked to the pressure chamber 66 formed in the pressure chamber plate 56.

Multiple ink pools 68 are formed in the flow path forming plate 52 and ink is supplied from ink supply ports. Further, multiple supplying holes 70 are formed in the continuous hole plate 54 so as to connect with the ink pools 68. These ink pools 68, supplying holes 70, and pressure chambers 66 are in communication in a state where the flow path forming plate 52, continuous hole plate 54, and pressure chamber plate 56 are stacked.

Further, piezoelectric elements 60 are fitted to the upper side of each pressure chamber 66 at the upper portion of the oscillation board 58. The piezoelectric elements 60 are each connected to a circuit board provided in the drive unit 72 shown in FIG. 2, and these are configured such that drive voltage is applied from the circuit board.

As shown in FIG. 3, an ink channel that runs from the ink pool 68 through the supplying hole 70, pressure chamber 66, continuous hole 64, continuous hole 62, and nozzle 16 is formed at this kind of recording head 12. Ink accumulated in the ink pools 68 is filled into the pressure chamber 66 through the supplying hole 70, and when drive voltage is applied to each piezoelectric element 60 from the circuit board, the oscillation board 58 flex deforms with the piezoelectric element 60 and makes the pressure chamber 66 expand or compress. When changes in volume occur in the pressure chamber 66 due to this flex deformation, pressure waves are generated in the pressure chamber 66. The ink moves due to the action of these pressure waves and ink droplets are ejected to the exterior from the nozzles 16.

With this ink-jet recording device 10, when wiping is performed without suction of ink from the nozzles 16, the drive voltage of voltage waveforms (drive waveforms) is applied to the piezoelectric element 60 from the circuit board prior to initiation of wiping, in a state such that ink droplets are not ejected and ink floods the nozzle face 17. After that, the drive unit 72 (see FIG. 2) rotates the motor 38 shown in FIG. 1 and moves the wiper plate 18 in the direction of the A arrow and wipes the nozzle face 17.

Figure 4:
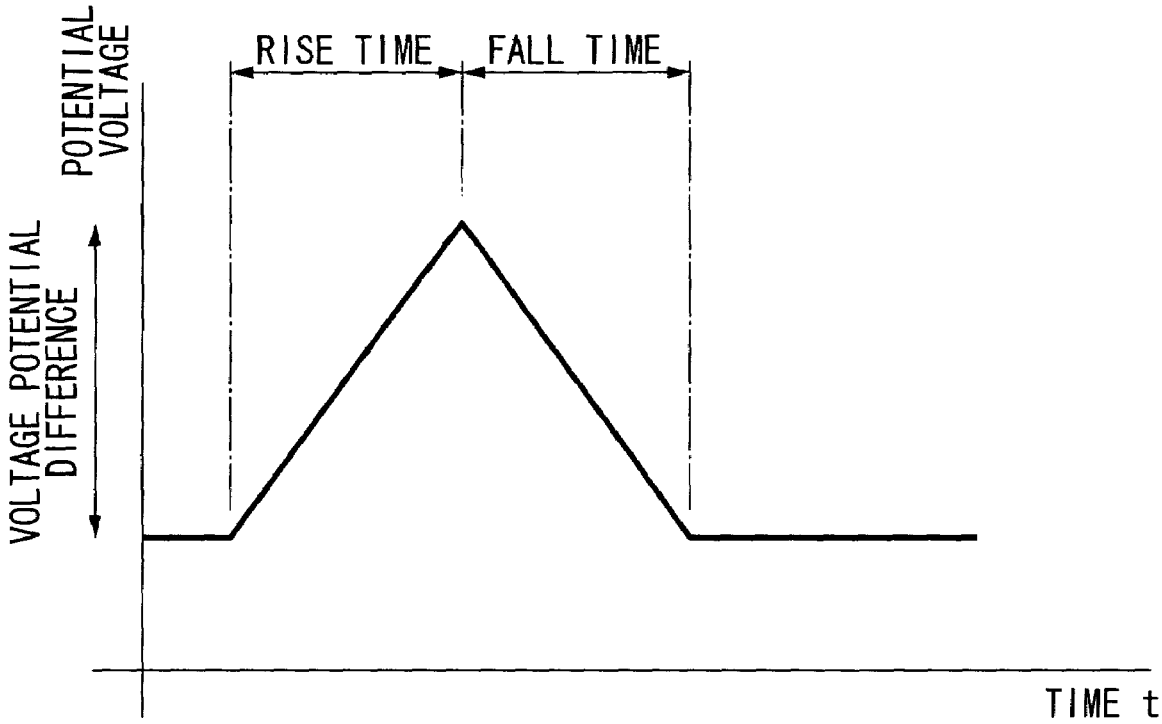
FIG. 4 is a diagram showing the voltage waveform of the drive voltage applied to a piezoelectric element at the time of wiping.

One example of the voltage waveform of drive voltage (drive waveform) applied to the piezoelectric element 60 at the time of this wiping is shown in FIG. 4. Further, in FIGS. 5A to 5E, the behavior of the ink of the unit head 14 at the time of the application of this drive voltage is shown in order from FIG. 5A to FIG. 5E.

As can be seen from FIG. 4, this voltage waveform is a triangular wave. When moving in the direction that makes the pressure chamber 66 contract, the voltage is raised, after which it moves in the direction that makes the pressure chamber 66 expand and the voltage drops. Here, the rise time (time of the rising portion) of the voltage waveform and the fall time (time of the dropping portion) are set to be longer than the inherent period of the pressure chamber 66. Due to this, ink droplets are not ejected from the nozzles 16 and a condition where ink floods the nozzle face 17 can be formed.

Next, the action of the ink-jet recording device 10 when the drive voltage shown in FIG. 4 is applied and the wiping method for the nozzle face 17 of the present embodiment will be explained.

Figure 5A:
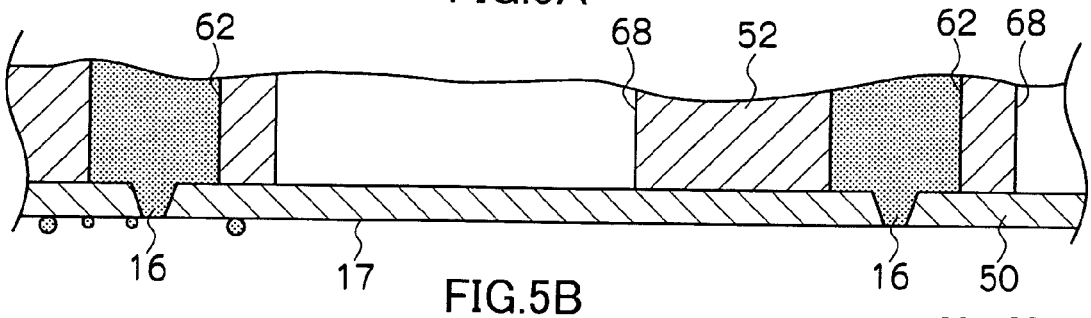
FIGS. 5A to 5E are diagrams explaining the operation of the ink-jet recording device at the time of wiping.
Figure 5B:
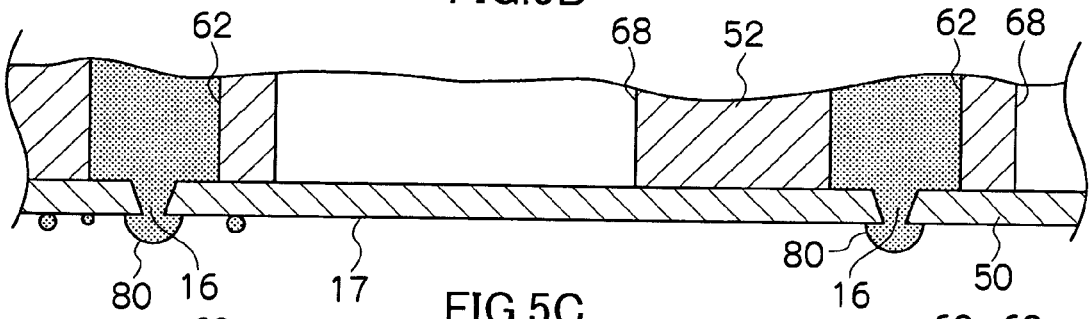
Figure 5C:
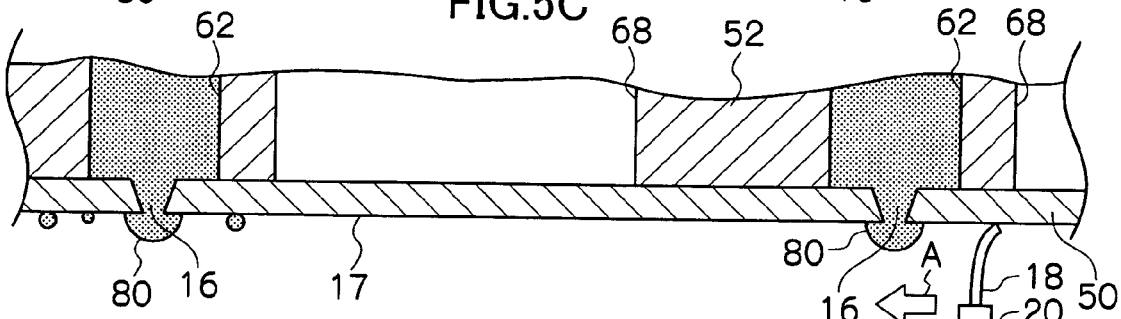

With this wiping method, the nozzle face 17 is wiped without performing suction of the ink from the nozzles 16. As shown in FIG. 5A, in a state where ink suction is not performed and the nozzle face 17 is dry, dirt from ink mist is stuck or fixed to the nozzle face 17. Prior to initiating wiping, the drive voltage shown in FIG. 4 is applied to each piezoelectric element 60 (see FIG. 3). This drive voltage is set at a voltage waveform to the extent that ink droplets do not eject from the nozzles 16, and ink floods over. Due to this, as shown in FIG. 5B, face floods 80 are generated at the nozzle face 17 of the vicinity of the nozzles 16. As shown in FIG. 5C, immediately after the application of drive voltage, the motor 38 (see FIG. 1) is made to rotate, the wiper plate 18 moved in the direction of the A arrow, and wiping of the nozzle face 17 performed.

Figure 5D:
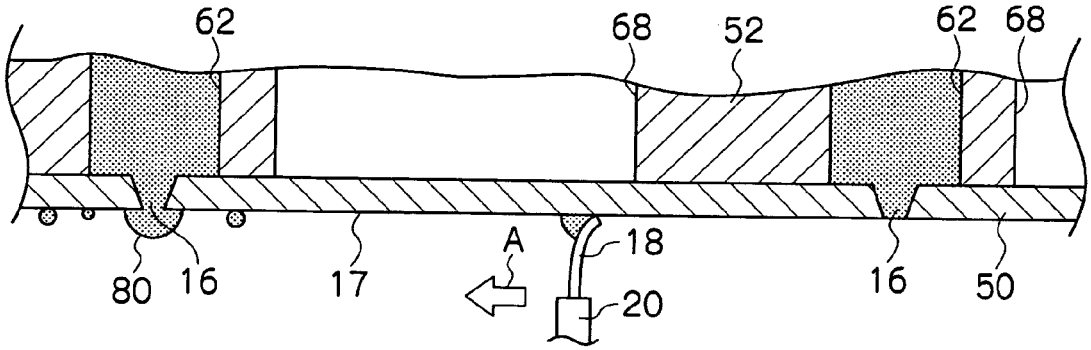
Figure 5E:
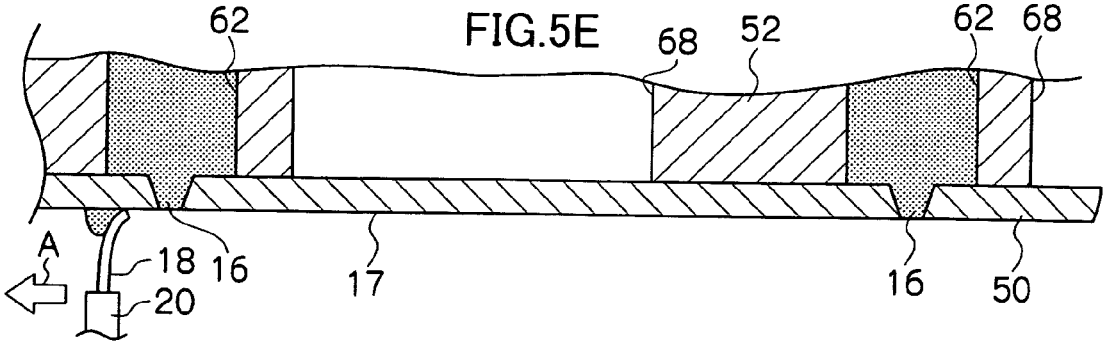

As shown in FIG. 5D, due to this wiping, the face flood 80 is scraped off with the wiper plate 18 and the ink gathers at the edge portion of the wiper plate 18. For this reason, the contacting portions of the wiper plate 18 and nozzle face 17 immediately after initiation of wiping are in a wet state. Further, as shown in FIG. 5E, the nozzle face 17 is wiped in a state where the contacting portions of the wiper plate 18 and nozzle face 17 are wet. For this reason, the nozzle face 17 is not wiped in a dry state and damage to the nozzle face 17 due to friction can be prevented. Further, fixed substances on the nozzle face 17 such as dirt and the like can be removed.

With this wiping method, after forming the face flood on the nozzle face 17, wiping can be performed after stopping the drive voltage or wiping can be performed with the drive voltage applied as is. With regard as to which can produce better wiping results, that depends on factors such as the diameters of the nozzles 16, the shapes of the nozzles 16, the viscosity of the ink, the water-repellant capability of the nozzle face 17, the back pressure of the ink (i.e., hydraulic head difference) and the material quality of the wiper plate 18.

In a case where the drive voltage is stopped, when the ink flooded on the nozzle face 17 is pulled back into the interior of the nozzles 16, it is set such that wiping is performed with the drive voltage applied as is. Further, the drive voltage can be stopped the instant the wiper plate 18 passes by.

With this recording head 12, it is necessary to set the appropriate conditions for the voltage waveform of the drive voltage applied to each piezoelectric element 60 (refer to FIG. 3) in order to form the face flood 80 on the nozzle face 17 (see FIGS. 5A to 5E). Here, the preferable conditions for the rise time, fall time, applied frequency, as well as the voltage potential difference of the greatest portion and smallest portion of the voltage waveform of the drive voltage were examined.

As shown in Table 1, the triangular wave shown in FIG. 4 is used as the voltage waveform. The voltage waveform rise time, fall time, and applied frequency are changed, and the state of face flooding is evaluated.

TABLE 1

| | | Voltage waveform applied frequency (times printing frequency) | | | | | | |
|---|---|---|---|---|---|---|---|---|
| | | Single | X 0.25 | X 0.50 | X 0.75 | X 1.00 | X 1.25 | X 1.50 |
| Voltage waveform rise/fall time (times inherent period) | X 0.50 | D | D | D | D | C | C | C |
| | X 0.75 | D | D | D | C | C | C | C |
| | X 1.00 | D | C | A | A | A | A | A |
| | X 1.25 | D | D | D | C | A | A | C |
| | X 1.50 | D | D | D | C | A | C | — |
| | X 1.75 | D | D | C | C | A | C | — |
| | X 2.00 | D | C | A | A | A | A | — |
| | X 2.25 | D | D | C | A | C | — | — |
| | X 2.50 | D | D | C | A | D | — | — |
| | X 2.75 | D | D | D | A | D | — | — |
| | X 3.00 | D | D | A | A | — | — | — |

In the evaluation of the face flooding of Table 1, "A" indicates that ink face flooding goes well, "C" indicates that ink face flooding is insufficient, "D" indicates that discharging of ink droplets and bubble engulfment occur, and "--" indicates that the length of the voltage waveform exceeds the discharging period.

It is understood from Table 1 that it is preferable that the rise time and fall time of the voltage waveform be one or more times the inherent period of the pressure chamber 66 (see FIG. 3). When setting the rise time and fall time of the voltage waveform to be X integer times the inherent period of the pressure chamber 66, face flooding goes especially well. Further, by making it X integer times the inherent period of the pressure chamber 66, unwanted manufacturing variations decrease.

Further, it is understood from Table 1 that it is preferable that the applied frequency of the voltage waveform be ½ times or more that of the printing frequency of the printing waveform applied when recording an image (i.e., when discharging ink droplets) and especially a range of ½ to one time the printing frequency of the printing waveform. Furthermore, it was discovered that if the applied frequency of the voltage waveform is set within the range of 18 kHz to 20 kHz, it does not grate on the ears as this is not within an audible range.

Moreover, according to the examinations made into the condition of face flooding due to the voltage potential difference of the voltage waveform (see FIG. 4), it was confirmed that is preferable that the voltage potential difference of the voltage waveform be in a range of ½ to one time the voltage potential difference of the printing waveform applied when recording an image (i.e., when discharging ink droplets). In other words, it is preferable that the voltage potential difference be as large as possible without causing the discharging of ink droplets. Even if the voltage waveform is made to be one time the voltage potential difference of the printing waveform at the time of image recording, the printing waveform of the image recording time has a rise time and fall time shorter than the voltage waveform shown in FIG. 4 (i.e., the gradient is large) so ink droplets do not eject. It should be noted that in FIG. 4, the rise time and fall time of the triangular wave are the same, however, it is not necessary to set these to be the same. Even if the rise time and fall time are changed, ink face flooding at the nozzle face 17 can be formed.

In the ink-jet recording device 10 of the present embodiment, the inherent period of the pressure chamber 66 is specifically set at 8 μsec to 20 μsec. Further, it is preferable that: the rise time and fall time of the voltage waveform be set at 8 μsec to 40 μsec; the voltage potential difference of the voltage waveform at 10V to 40V; and the applied frequency of the voltage waveform at 18 kHz to 20 kHz.

It should be noted that although with the present embodiment, the voltage waveform of the drive voltage at the time of wiping was a triangular wave, it is not limited to this only. For example, a trapezoidal wave and the like are also acceptable.

With the present embodiment, wiping is performed without ink suction, however, the present invention is not limited thereto. The present invention can be applied without distinguishing between whether ink suction is or is not performed.

The ink-jet recording device of the above-described embodiment is one that records images (including characters) on a paper P, however, the present invention is not thus limited. That is, the recording medium is not limited to paper and the ejected liquid is not limited to ink. All droplet-injecting apparatuses used in industrial applications are included, for example, those used when discharging ink on polymer film and glass for making color filters for displays; and when discharging solder in a welding state for making bumps for parts mounting.

The ink-jet recording device of the first aspect of the present invention has an ink-jet recording head that operates pressure waves on the ink in the pressure chamber and ejects ink droplets from multiple nozzles; a wiper that wipes the nozzle face of the ink-jet recording head; a drive waveform applying component that applies a drive waveform to a drive element so that ink droplets do not eject and ink floods the nozzle face; and a control component that, when wiping is performed, drives the drive waveform applying component prior to the initiation of wiping, and makes the wiper actuate when the ink is in a flooded state on the nozzle face.

In the ink-jet recording device of the first aspect, the drive waveform can be a waveform that either contracts or expands the pressure chamber.

By applying a drive waveform that makes the pressure chamber contract before expanding, it becomes difficult for the ink to enter inside the nozzles directly after applying the drive waveform, and further, a condition can be formed where ink droplets are not ejected and ink floods the nozzle face.

In the ink-jet recording device of the first aspect, the rise time and fall time of the drive waveform can be set so as to be longer than the inherent period of the pressure chamber.

By setting the rise time and fall time of the drive waveform to be longer than the inherent period of the pressure chamber, a state where ink is flooded on the nozzle face, without ink droplets being ejected, can be formed.

In the ink-jet recording device of the first aspect, the rise time and fall time of the drive waveform can be set so as to be X integer times the inherent period of the pressure chamber.

By setting the rise time and fall time of the drive waveform to be X integer times the inherent period of the pressure chamber, a condition can be formed where ink floods the nozzle face without ink droplets being ejected.

In the ink-jet recording device of the first aspect, the voltage potential difference of the drive waveform can be made to be in the range of ½ times to one time the voltage potential difference of the printing waveform when discharging ink droplets.

By making the voltage potential difference of the drive waveform in the range of ½ times to one time the voltage potential difference at the time of the discharging of ink droplets, a condition can be formed where the nozzle face is flooded with ink without discharging ink droplets.

In the ink-jet recording device of the first aspect, the applied frequency of the drive waveform can be made to be in the range of ½ times to one time the printing frequency of the printing waveform when discharging ink droplets.

By making the applied frequency of the drive waveform in the range of ½ times to one time the printing frequency of the printing waveform at the time of the discharging of ink droplets, a condition can be formed where the nozzle face is flooded with ink without discharging ink droplets.

In the ink-jet recording device of the first aspect, the applied frequency of the drive waveform can be made to be in the range of 18 kHz to 20 kHz.

By making the applied frequency of the drive waveform in the inaudible region of 18 to 20 kHz, the generation of grating noise at the time of application of the drive waveform can be prevented.

What is claimed is:

1. An ink-jet recording device comprising:

an ink-jet recording head that operates pressure waves on ink in a pressure chamber and ejects ink droplets from a plurality of nozzles;

a wiper that wipes a nozzle face of the ink-jet recording head;

a drive waveform applying component that applies a drive waveform to a drive element such that ink droplets are not ejected and ink floods the nozzle face; and a control component that, when wiping is being performed, drives the drive waveform applying component prior to the initiation of wiping and actuates the wiper when the ink is in a flooded condition on the nozzle face;

wherein the drive waveform is a triangular waveform.

2. The ink-jet recording device of claim 1, wherein the drive waveform is a waveform that makes the pressure chamber contract before making it expand.

3. The ink-jet recording device of claim 1, wherein a rise time and fall time of the drive waveform are set so as to be longer than an inherent period of the pressure chamber.

4. The ink-jet recording device of claim 1, wherein a rise time and fall time of the drive waveform are set so as to be an integer times an inherent period of the pressure chamber.

5. The ink-jet recording device of claim 1, wherein the voltage potential difference of the drive waveform is made to be in the range of ½ times to one time the voltage potential difference of the printing waveform at the time of the discharging of ink droplets.

6. The ink-jet recording device of claim 1, wherein the applied frequency of the drive waveform is made to be in the range of ½ times to one time the printing frequency of the printing waveform at the time of the discharging of ink droplets.

7. The ink-jet recording device of claim 1, wherein the applied frequency of the drive waveform is made to be in the range of from 18 kHz to 20 kHz.

8. A wiping method that wipes a nozzle face of an ink-jet recording head without performing suction of ink, the method comprising:

applying a drive waveform to a drive element so that, prior to initiating wiping, ink droplets are not ejected and ink floods the nozzle face; and wiping the nozzle face in a state where ink is flooded on the nozzle face;

wherein the drive waveform is a triangular waveform.

9. The wiping method of claim 8, wherein the drive waveform is a waveform that makes the pressure chamber contract before making it expand.

10. The wiping method of claim 8, wherein a rise time and fall time of the drive waveform are set so as to be longer than an inherent period of the pressure chamber.

11. The wiping method of claim 8, wherein a rise time and fall time of the drive waveform are set so as to be an integer times an inherent period of the pressure chamber.

12. The wiping method of claim 8, wherein the voltage potential difference of the drive waveform is made to be in the range of ½ times to one time the voltage potential difference of the printing waveform at the time of discharging of ink droplets.

13. The wiping method of claim 8, wherein the applied frequency of the drive waveform is made to be in the range of ½ times to one time the printing frequency of the printing waveform at the time of discharging of ink droplets.

14. The wiping method of claim 8, wherein the applied frequency of the drive waveform is made to be in the range of from 18 kHz to 20 kHz.

* * * * *